US006966210B2

(12) United States Patent
Klann

(10) Patent No.: US 6,966,210 B2
(45) Date of Patent: Nov. 22, 2005

(54) TOOL FOR FLANGING COATED BRAKE PIPES

(75) Inventor: Horst Klann, Villingen-Schwenningen (DE)

(73) Assignee: Klann Tools Ltd., Oxfordshire (GB)

( * ) Notice: Subject to any disclaimer, the term of this patent is extended or adjusted under 35 U.S.C. 154(b) by 101 days.

(21) Appl. No.: 10/662,705

(22) Filed: Sep. 15, 2003

(65) Prior Publication Data

US 2004/0083785 A1 May 6, 2004

(30) Foreign Application Priority Data

Sep. 16, 2002 (DE) ..... 202 14 364 U

(51) Int. Cl.[7] ..... B21D 19/08
(52) U.S. Cl. ..... 72/318; 72/370.11
(58) Field of Search ..... 72/316–318, 125, 72/116, 370.1, 370.03, 370.11; 269/257, 269/270, 287

(56) References Cited

U.S. PATENT DOCUMENTS

| | | | | |
|---|---|---|---|---|
| 1,372,197 A | * | 3/1921 | Rudolph | 72/117 |
| 1,754,637 A | * | 4/1930 | McGough | 72/318 |
| 2,180,033 A | * | 11/1939 | Cattoi | 72/116 |
| 2,430,168 A | | 11/1947 | Graham | |
| 2,555,591 A | * | 6/1951 | Kane, Jr. | 285/334.5 |
| 3,038,490 A | * | 6/1962 | Yocum | 137/318 |
| 4,104,902 A | * | 8/1978 | Cease | 72/117 |

FOREIGN PATENT DOCUMENTS

| | | |
|---|---|---|
| DE | 32 30 444 C2 | 2/1984 |
| DE | G 91 04 311.5 | 7/1991 |
| DE | 299 20 821 U1 | 3/2000 |
| DE | 299 20 822 U1 | 4/2000 |

* cited by examiner

*Primary Examiner*—Daniel C. Crane
(74) *Attorney, Agent, or Firm*—McGlew and Tuttle, P.C.

(57) ABSTRACT

A tool for flanging coated brake pipes has a basic body with a receiving groove and a clamping jaw with a clamping groove. The receiving groove and the clamping groove form a clamping channel, in which the brake pipe can be received snugly. To achieve the snug hold of the brake pipe without unacceptable deformations as well as the coaxial alignment of this brake pipe in relation to a pressure piece of the basic body, by which the flanged head is formed, different surfaces of the receiving groove and of the clamping groove are provided. Thus, the surfaces may be provided with a surface roughness with an arithmetic average peak-to-valley height Ra of 5.0 to 10.0. Furthermore, as an alternative or in addition hereto, different surface profiles of these surfaces of the receiving groove and of the clamping groove are provided, which have in common the feature that these surfaces are provided in the axial and/or circumferential direction with flat sections, which form flat depressions, which have a maximum depth of 0.1 mm.

21 Claims, 5 Drawing Sheets

TOOL FOR FLANGING COATED BRAKE PIPES

FIELD OF THE INVENTION

The present invention pertains to a tool for flanging coated brake pipes of a motor vehicle, comprising a basic body with an approximately semicylindrical receiving groove, which forms a clamping channel for clampingly holding the brake pipe with an approximately semicylindrical clamping groove of a clamping jaw, and a pressing spindle, which is arranged in the basic body, extends coaxially with the clamping channel, is adjustable in relation to the clamping channel and is provided at its channel-side end with a pressure piece forming the flanged head of the brake pipe, wherein the diameter of the clamping channel at right angles to the parting plane of the basic body and the clamping jaw is smaller at least approximately over its entire length than the pipe diameter of the brake pipe.

BACKGROUND OF THE INVENTION

A tool for flanging metal pipes has already been known from, e.g., DE 32 30 444 C2, which tool is intended especially for flanging coated brake pipes of a motor vehicle. This tool, called a flanging press, comprises two parallelepipedic clamping blocks, which have each a plurality of pipe insertion grooves, which are adjusted to certain pipe diameters and are milled to an approximately semicylindrical cross section. These clamping blocks can be braced against each other by means of a screwing device.

Furthermore, a pressing spindle arranged coaxially to a brake pipe clamped between the clamping blocks with replaceable flanging pressure pieces is provided. Furthermore, the sum of the depths of the two pipe insertion grooves belonging together is smaller in this prior-art tool than the pipe diameter of the brake pipe to be flanged.

To make it possible to satisfactorily clamp a brake pipe, especially when it has a plastic coating, as is the case with brake pipes, provisions are made in the prior-art tool for the pipe insertion grooves of the two clamping blocks to have different depths and for at least the deeper pipe insertion groove to be broader than the diameter of the pipe to be clamped. The depth of the pipe insertion groove of one clamping block is greater by about 0.1 mm to 0.4 mm than the radius of the brake pipe to be flanged, while the depth of the other pipe insertion groove of the other clamping block is smaller by at least 0.4 mm than the radius of the brake pipe to be flanged. This design shall lead to asymmetric clamping during the bracing or clamping of the brake pipe in relation to the central axis of the pipe.

It was now found that because of this asymmetric clamping, exact coaxial alignment of the brake pipe to be flanged in relation to the pressing spindle with its replaceable flanging pressure pieces is not guaranteed, especially in the case of brake pipes on which the plastic coating has a greater wall thickness. Furthermore, oval deformation of the brake pipe in question can be frequently observed because of the described dimensions of the individual pipe insertion grooves, as a result of which a male pipe fitting, which is used in brake pipes, is prevented from being able to be pushed over.

On the other hand, as can be determined from the document DE 32 30 444 C2, this shaping is, in turn, essentially necessary in order to make it possible to apply sufficiently strong clamping forces to the brake pipe in the radial direction in order to avoid a displacement in the axial direction during the preparation of the flanged head on the coated brake pipe. In particular, the surface of the plastic coating shall not be damaged. This tool is suitable for brake pipes whose coating is relatively thin. Brake pipes with a greater coating thickness have become known more recently. It was found in these cases that a sufficient, clamping hold of the brake pipes with "thicker" coating can be guaranteed only conditionally by the prior-art flanging press. This is also due, among other things, to the greater dimensional tolerances of the thicker plastic coating and consequently of the actual external diameter of the brake pipe as well as to the greater flexibility of this coating. Even though a snug, clamping hold of the brake pipe in the pipe insertion grooves can be achieved if stronger pressing forces are generated, this leads to a greater deformation of the brake pipe in the area of the flanged head.

Since these deformations develop in the immediate vicinity of the flanged head, precise preparation of such a flanged head conforming to the standards within the preset tolerances is not possible. Thus, on the one hand, this unacceptable permanent deformation of the brake pipe, especially in the area of the flanged head to be prepared, as well as the not exactly coaxial alignment of the brake pipe in relation to the pressing spindle and consequently to the replaceable flanging pressure piece of the pressing spindle during the preparation of a flanged head at the end of the brake pipe always lead to flanged head shapes which are no longer within the tolerance range of a standardized flanged head.

SUMMARY OF THE INVENTION

Accordingly, the basic object of the present invention is to improve a tool of this class such that the flanged head of a plastic-coated brake pipe can be prepared so accurately that the dimensions of the flanged head are within the specified tolerances and an unacceptable deformation, especially of the plastic coating, is prevented from occurring.

It is achieved especially advantageously due to the design according to the present invention that the coated brake pipe to be flanged is not deformed in an unacceptable manner during the clamping.

To also achieve a secure hold of the coated brake pipe being clamped, it is proposed that the surfaces of the receiving groove and the clamping groove, which form the clamping channel, have an arithmetic average peak-to-valley height Ra of 5.0 to 10.0, that these surfaces be provided with depressions, which are located one after another in the circumferential direction and are formed by cylinder sections of the receiving groove and the clamping groove, which said cylinder sections follow each other in the circumferential direction, and the depressions have alternatingly equal or different radii of curvature, and that the radial depressions formed hereby have a maximum depth of 0.1 mm, or that the surfaces be provided with depressions, which are located one after another axially and which are formed by groove sections of different groove depth, which follow each other axially, and that the groove width of the groove sections used for the clamping hold be constant and correspond to the external diameter of the coated brake pipe to be flanged, the surfaces are provided in the circumferential direction and/or in the axial direction with depressions, which have a maximum depth of 0.1 mm. The surface of the coating of a brake pipe is reliably prevented from being unacceptably deformed during clamping, on the one hand, and, on the other hand, sufficiently strong adhesion of the clamped brake pipe in the clamping channel is achieved due to the surface roughness and this small depth of the depressions. Sufficiently precise coaxial alignment of the brake pipe in relation to the flanging pressure piece is also guaranteed due to the extremely slight deformation of the surface of the brake pipe.

Due to this sufficiently precise alignment, the slight deformation of the surface of the brake pipe as well as the snug hold of the coated brake pipe in the clamping channel, a flanged head conforming to the standards, which is also always within the permissible dimensional tolerances, can be prepared by means of the flanging pressure piece at the end of the brake pipe.

Thus, according to the invention, the receiving groove and the clamping groove can have a surface roughness with an arithmetic average peak-to-valley height Ra between 5.0 and 10.0, i.e., depressions generated by this "roughening" have a maximum depth of 0.02 mm, so that an unacceptable deformation of or even damage to the surface coating of the brake pipe is also reliably ruled out by this "roughness." Furthermore, this design ensures a sufficiently firm hold of the brake pipe during the preparation of the flanged head.

The cylinder sections following each other in the circumferential direction have equal or different radii of curvature, so that a kind of radially expanded "receiving pockets" are formed in some areas due to this design. The radial depth shall be preferably limited to 0.1 mm. The radial depth is defined here as the radial distance between these curved inner surfaces of the receiving groove and the clamping groove and an inner circle or inner cylinder, which is located completely within these cylinder sections.

The cylinder sections following each other may also form a kind of wave profile in the circumferential direction. On the one hand, a uniform, coaxial alignment of a coated brake pipe to be flanged is achieved in the clamped state. On the other hand, an unacceptable deformation of or even damage to the surface of a coated brake pipe during clamping is reliably prevented from occurring because of the extremely small depth of the individual cylinder sections, and the "wave profile" brings about an increased static friction of the clamped coated brake pipe in the clamping channel, so that secure hold of such a coated brake pipe in the clamping channel is also ensured.

An extremely secure hold of the coated brake pipe to be flanged in the clamping channel is also ensured by further features, and alignment coaxially with the pressing spindle is likewise ensured. An unacceptable deformation of the brake pipe during clamping is also prevented from occurring due to the fact that the groove width corresponds to the external diameter of the brake pipe to be flanged. In particular, the brake pipe cannot widen up in a direction at right angles to its longitudinal central axis, so that a "hollow screw" to be pushed over this brake pipe after the flanging operation is reliably freely rotatable.

Two different groove depths of the groove sections may be provided. The groove sections of the receiving groove of a smaller depth are associated now in pairs with the groove sections of the clamping groove of a smaller depth, i.e., when the basic body and the clamping jaw lie one on top of another, the resulting clamping channel has sections of greater diameter and sections of a smaller diameter at right angles to the parting plane between the basic body and the clamping jaw, and these sections follow each other alternatingly in the axial direction. A clamping force acting uniformly on the circumference of the brake pipe is achieved due to this design, so that the brake pipe is received concentrically in the clamping channel.

Provisions may be made for the difference of the sum of the groove depths of the receiving groove and the clamping groove to be in a range between 0.025 mm and 0.1 mm and preferably to equal 0.07 mm, i.e., the steps in the receiving groove and in the clamping groove, when each is considered in itself, are at most 0.05 mm. To achieve a sufficiently strong clamping force and to prevent an unacceptable deformation of the surface of the coating of a brake pipe, a step of preferably 0.035 mm is provided here. The receiving groove and the clamping groove preferably have an identical or mirror symmetrical design.

Provisions may be made for the groove sections to have an axial length of about 4 mm to 11 mm. Relatively large pressing surfaces of the individual groove sections are obtained due to this design, so that damage to the surface of the clamped brake pipe is reliably ruled out despite the fact that the surface pressure is high. For example, provisions may be made here for the groove sections of a smaller depth to have an axial length of about 10 mm and for the groove sections of a greater depth to have an axial length of about 5 mm.

The surfaces of the receiving groove and of the clamping groove, which may have different designs may be provided in different combinations with one another. This means that both a surface roughness and depressions in the form of the cylinder sections and also the depressions in the form of the different groove depths of the individual groove sections may be provided in a combined form. In particular, a considerably increased adhesion of the clamped coated brake pipe in the clamping channel is achieved due to the combination especially of the surface roughness and optionally of the depressions in the circumferential direction or of the depressions in the axial direction. It is common to all embodiments and combinations of features that a clamped coated brake pipe of a motor vehicle is aligned extremely accurately in relation to the pressing spindle and consequently to the flanging pressure piece in the state in which it is completely clamped in the clamping channel, so that the dimensions of the flanged head to be prepared at the end of the coated brake pipe are also within the standardized tolerances for such flanged heads.

Provisions may be made for the sum of the groove depths of the receiving groove and of the clamping groove to be smaller by up to 1.9% than the external diameter of the brake pipe to be flanged or clamped. Unacceptably great permanent deformations during the clamping of the brake pipe are prevented by this measure, and sufficiently strong clamping forces are also obtained at the same time.

Provisions may be made for the receiving groove and the clamping groove to have a width that corresponds to the external diameter of the brake pipe in the area of the parting plane between the basic body and the clamping jaw. As was mentioned, an unacceptable permanent widening of the brake pipe is prevented by this measure.

Due to an embodiment according to the invention, the formation of a burr extending along the parting plane between the basic body and the clamping jaw is reliably prevented from forming or it is at least reduced to such an extent no burr projecting unacceptably to the outside is left after the flanging operation on the brake pipe. Provisions are made for this purpose for the limiting edges of the receiving groove and of the clamping groove to be rounded toward the respective parting plane belonging to them and to have a radius of curvature of 0.1 mm to a maximum of 0.4 mm. Furthermore, no coating material of the brake pipe can enter the gap between the basic body and the clamping jaw during the clamping, either, so that the basic body and the clamping jaw always lie flat on one another in the parting plane.

Provisions may be made for the clamping channel to have a round cross section, whose diameter corresponds to about 93% to 98% of the external diameter of the brake pipe, especially of a coated brake pipe, in the area of the end of the clamping channel that is directed toward the pressing spindle, over an axial length of 4 mm to 6 mm. The round shape of the brake pipe is reliably maintained due to this measure in the area of the flanged head to be prepared in this end area, so that maximum precision of the flanged head to be prepared can be achieved in case of the precise axial alignment of the coated brake pipe, especially in this end area.

Furthermore, provisions may be made for the limiting edges of the receiving groove and of the clamping groove to have sharp edges in the area of their cylindrical sections to the respective parting plane belonging to them. Burr formation is reliably prevented from occurring at the flanged head due to this embodiment.

Provisions may be made for the clamping channel to have a hollow with a depth of up to 1 mm, whose conical surface extends at an angle of 25° to 60° in relation to the central longitudinal axis of the clamping channel, toward the pressing spindle, and for the limiting edges of the respective hollow to the respective parting plane to have sharp edges. Precise shaping of the flanged head in its transition area to the rest of the brake pipe is ensured by this embodiment, and the formation of a burr at the flanged head is reliably prevented from occurring or is at least reduced to such an extent that it can be removed in a simple manner.

Furthermore, provisions may be made for the clamping channel to have an outlet section of a length of up to 3 mm in the form of a hollow, which extends at an outlet angle of 10° to 20° to the central longitudinal axis of the clamping channel, at its end located opposite the pressing spindle. In particular, damage to the coating of the brake pipe in the outlet area is prevented by this embodiment from occurring.

The clamping jaw may have at its front side directed toward the pressing spindle a swing wall, which can be pivoted from a neutral position into the intermediate space between the clamping groove and the pressing spindle or the flanging pressure piece of the pressing spindle for positioning the coated brake pipe to be flanged. Due to this pivoting of the swing wall into the intermediate space, this swing wall forms a stop for the brake pipe in this pivoted-in position. The projecting length of the brake pipe jutting out of the clamping channel can thus be determined accurately, so that this will in turn contribute to the precise shaping or forming of the flanged head during the subsequent flanging operation.

The receiving groove and the clamping groove may have the same bottom depth. It is also achieved due to this measure that the brake pipe will be aligned sufficiently accurately coaxially with the pressing spindle and consequently with the flanging pressure piece during the clamping, i.e., that the clamping channel formed from the receiving groove and the clamping groove when the clamping jaw is pressed completely onto the basic body is aligned accurately with the axis of rotation of the pressing spindle and consequently with the flanging pressure piece arranged at the pressing spindle.

Provisions may be made for the clamping channel formed from the receiving groove and the clamping groove to have a clamping length of 6 cm to 9 cm for receiving the coated brake pipe. A clamping length of about 7 cm is preferably provided here. A sufficiently large "clamping surface" and consequently a sufficient hold of the brake pipe in the clamping channel are achieved due to this measure, and the dimensions of the entire device are still convenient for easy handling, especially for use directly at a motor vehicle.

A clamping web, by means of which the entire tool can be stationarily clamped in a vise or the like, can be detachably fastened to the basic body. This measure makes possible the stationary use of the entire tool. Such a use is intended whenever it is not necessary or possible to work directly at the vehicle.

A handle extending at right angles to the clamping channel and at right angles to the clamping web may be detachably fastened to the clamping web. Due to this measure, especially due to the removability of the handle from the clamping web, the tool according to the present invention can be changed over in a simple manner as desired for "manual use" directly at a motor vehicle and for stationary use.

The present invention will be explained in greater detail below on the basis of the drawings. The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DESCRIPTION OF THE PREFERRED EMBODIMENTS

Figure 1:
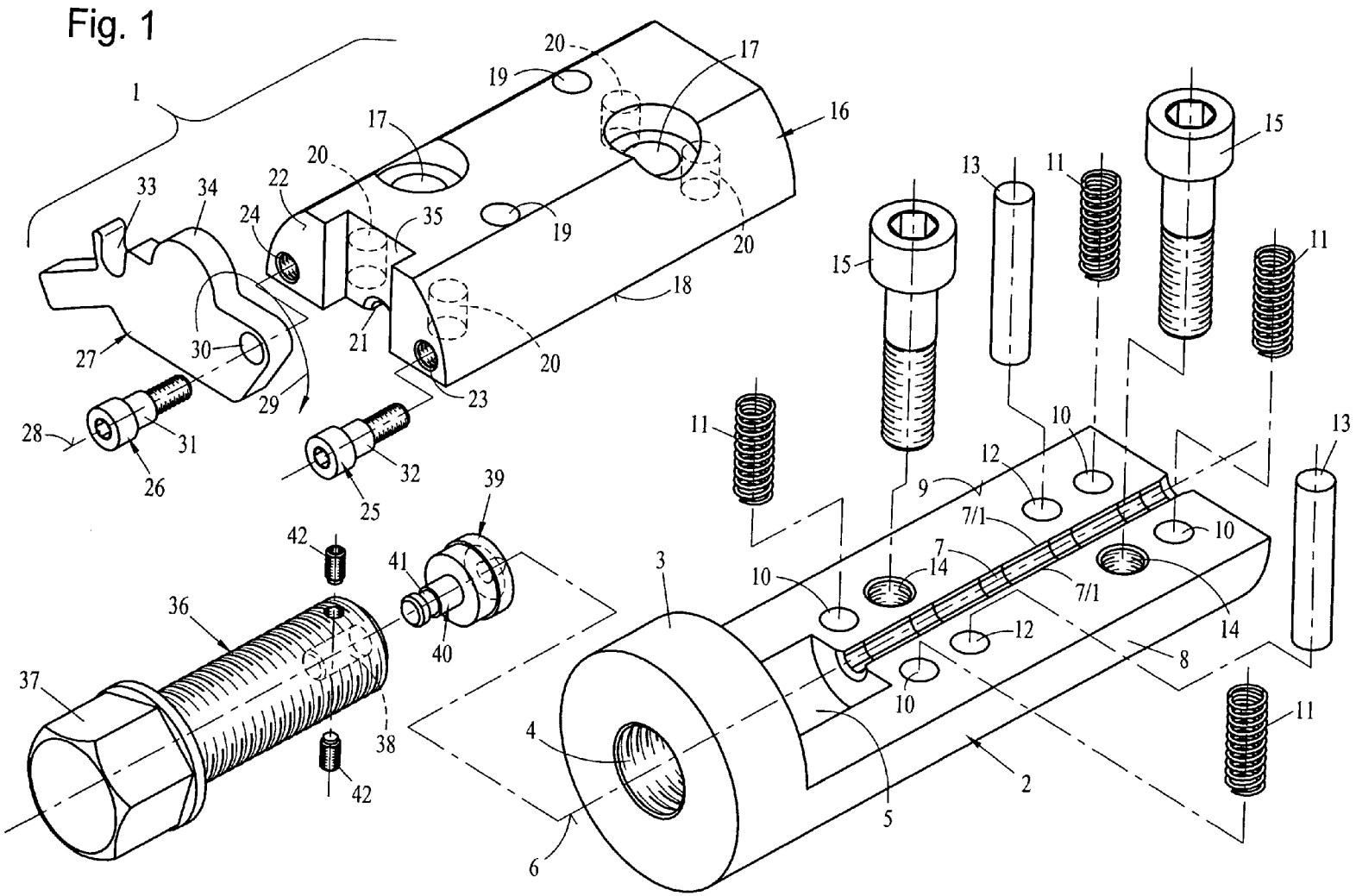
FIG. 1 is a perspective exploded view of the basic components of a tool according to the present invention.

Referring to the drawings in particular, FIG. 1 shows a perspective exploded view of the basic elements of a tool 1 according to the present invention. This tool 1 according to the present invention comprises a basic body 2, which has a cylindrical head part 3 in one of its end areas, and the head part 3 is provided with an internal thread 4. "Behind" this head part 3 in the axial direction, the basic body 2 has an approximately semicylindrical recess 5, whose radius is greater than the radius of the internal thread 4.

This semicylindrical recess 5 is arranged coaxially with the central axis 6 of the internal thread 4 as well as of the head part 3. In the axial direction, opposite the head part 3, the recess 5 is joined by a receiving groove 7, which is used during use to receive a coated brake pipe of a motor vehicle for flanging. As can be also recognized from FIG. 1, the basic body 2 is designed as a semicylinder 8 in the area of its recess 5 as well as of its receiving groove 7. This semicylinder 8 has a flat parting plane 9 in the area of the recess 5 as well as of the receiving groove 7.

As can be recognized from FIG. 1, the basic body 2 is provided on both sides of its receiving groove 7 with four blind holes 10, which are used to receive a coil spring 11 each and are arranged in the end areas of the receiving groove 7 symmetrically to the receiving groove 7. Furthermore, two mounting holes 12, into which an alignment pin 13 each can be snugly pressed, are provided on both sides of the receiving groove 7.

Located opposite the respective mounting hole 12 in relation to the receiving groove 7, the basic body 2 has an internal thread 14 each, into which a tightening screw 15 can be screwed. These tightening screws 15 are used to fasten a clamping jaw 16 to the basic body 2, the clamping jaw having corresponding through holes 17 for this.

Furthermore, it can be seen in FIG. 1 that this clamping jaw 16 forms a flattened semicylinder, whose lower parting plane 18 in FIG. 1 is likewise flat. The clamping jaw 16 can be placed fittingly on the parting plane 9 of the basic body 2 with this parting plane 18. The clamping jaw 16 has two through holes 19 for this purpose, with which the clamping jaw 16 can be placed on the alignment pins 13 pressed into the basic body 2 with an extremely small clearance and in an accurately aligned manner.

Furthermore, the clamping jaw 16 is also provided with blind holes 20, which are open toward its parting plane 18 and into which protrude the coil springs 11 in the mounted state and hold the clamping jaw 16 at a spaced location from the basic body 2 in the nonclamped state.

It is easy to imagine that by tightening the tightening screws 15 in the mounted state, the clamping jaw 16 can be pressed with its parting plane 18 flat onto the parting plane 9 of the basic body 2.

FIG. 1 also indicates that the clamping jaw 16 has a clamping groove 21 in the area of its parting plane 18, and the clamping groove 21 forms a clamping channel in the mounted state of the clamping jaw 16 at the basic body 2 together with the receiving groove 7 to clampingly receive a coated brake pipe to be flanged.

Furthermore, in the lower, outer edge areas of its front surface 22, the clamping jaw 16 is provided with two threaded holes 23 and 24, into which a respective mounting screw 25 and 26 can be screwed. The mounting screw 26 is used to pivotably mount a swing wall 27, which can be pivoted around the central longitudinal axis 28 from the neutral pivoting position shown in FIG. 1 into an active position by about 180° in the direction of arrow 29. For this pivotable mounting of the swing wall 27, this wall has a corresponding through hole 30 in one of its end areas, and the swing wall 27 is mounted with this through hole on a cylindrical bearing section 31 of the mounting screw 26 with a small clearance.

The second mounting screw 25 is used in the mounted state to fix the active pivoted position of the swing wall 27. This mounting screw 25 likewise has a bearing section 32 for this purpose, which engages a corresponding recess 33 of the swing wall 27 in the active pivoted position of the swing wall 27. This recess 33 is arranged correspondingly opposite the through hole 30.

Furthermore, an approximately semicylindrical stop 34, which protrudes into the recess 5 of the basic body 2 in the mounted state and in the active pivoted position of the swing wall 27, is made in one piece with the swing wall 27.

As is also apparent from FIG. 1, a central hollow 35, which is arranged symmetrically to the clamping groove 21 of the clamping jaw 16 and extends over the entire height of the clamping jaw 16 in this exemplary embodiment, is provided in the area of the front surface 22. Due to this hollow 35, the front end of the clamping groove 21 is set back by a predetermined amount in relation to the front surface 22, so that the swing wall 27 is located at the same distance from the front end of the clamping groove 21 in its active state. In the mounted state of the clamping jaw 16 on the basic body 2, the clamping groove 21 ends in an accurately fitting manner with the front end of the receiving groove 7 of the basic body 2.

As is also apparent from FIG. 1, the tool 1 has a pressing spindle 36, which is provided with a drive hexagon 37 at one of its outer ends. At its end located opposite this drive hexagon 37, the pressing spindle 36 is provided with a mounting hole 38, into which a flanging pressure piece 39 can be replaceably inserted. The flanging pressure piece 39 has a corresponding mounting pin 40 for this purpose, which is in turn provided itself with a circular securing groove 41. In the mounted state this securing groove 41 is used to captively hold the flanging pressure piece 39 in the mounting hole 38. Two stud screws 42, which can be screwed in the transverse direction into the pressing spindle 36 in a corresponding axial position from the outside, as is indicated in FIG. 1, are provided for this purpose in this exemplary embodiment.

Figure 2:
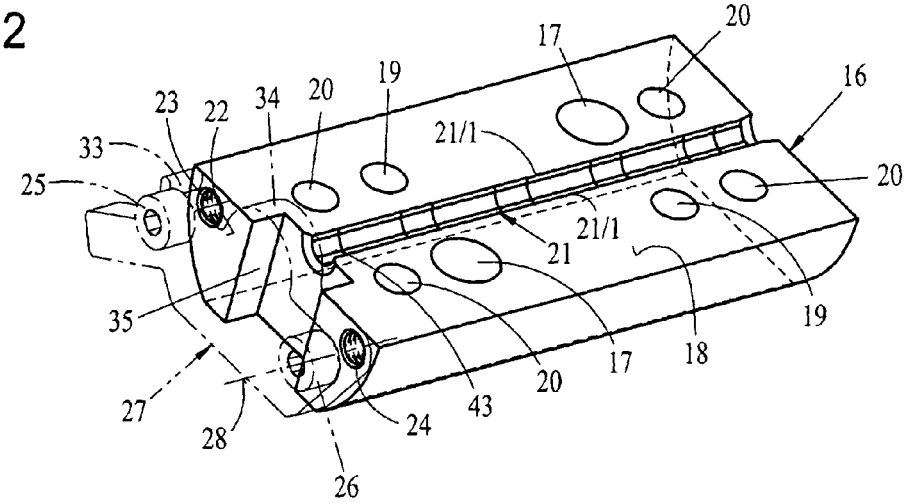
FIG. 2 is a perspective bottom view of the clamping jaw from FIG. 1.

FIG. 2 shows a perspective bottom view of a clamping jaw 16. It can be recognized from this bottom view that the clamping groove 21 has a design identical to that of the receiving groove 7 of the basic body 2 from FIG. 1. FIG. 2 shows, furthermore, that the parting plane 18 is flat. The four blind holes 20 for receiving the coil springs 11 are arranged in pairs symmetrically to the clamping groove 21 and are located in the front and rear end areas of the clamping jaw 16, respectively. The two through holes 17 for the tightening screws 15 are arranged between the blind holes 20. The two through holes 19, which are used in cooperation with the two alignment pins 13 for the accurate alignment of the clamping jaw 16 in relation to the basic body 2, are provided opposite one of these through holes 17 each relative to the clamping groove 21.

FIG. 2 also shows the swing wall 27 in phantom lines; it is located in its active, closed position at the front surface 22 of the clamping jaw 16. It can be clearly recognized that the swing wall 27 is received pivotably on the clamping jaw 16 via the mounting screw 26. Furthermore, the swing wall 27 engages with its recess 33 the second mounting screw 25 in a positive-locking manner in the active position shown in FIG. 2, so that the active position of the swing wall 27 is unambiguously fixed by the two mounting screws 25 and 26, as is shown in FIG. 2.

Furthermore, it can also be recognized from FIG. 2 that the front end 43 of the clamping groove 21 is arranged set back in relation to the front surface 22 of the clamping jaw 16 because of the hollow 35 provided.

Figure 3:
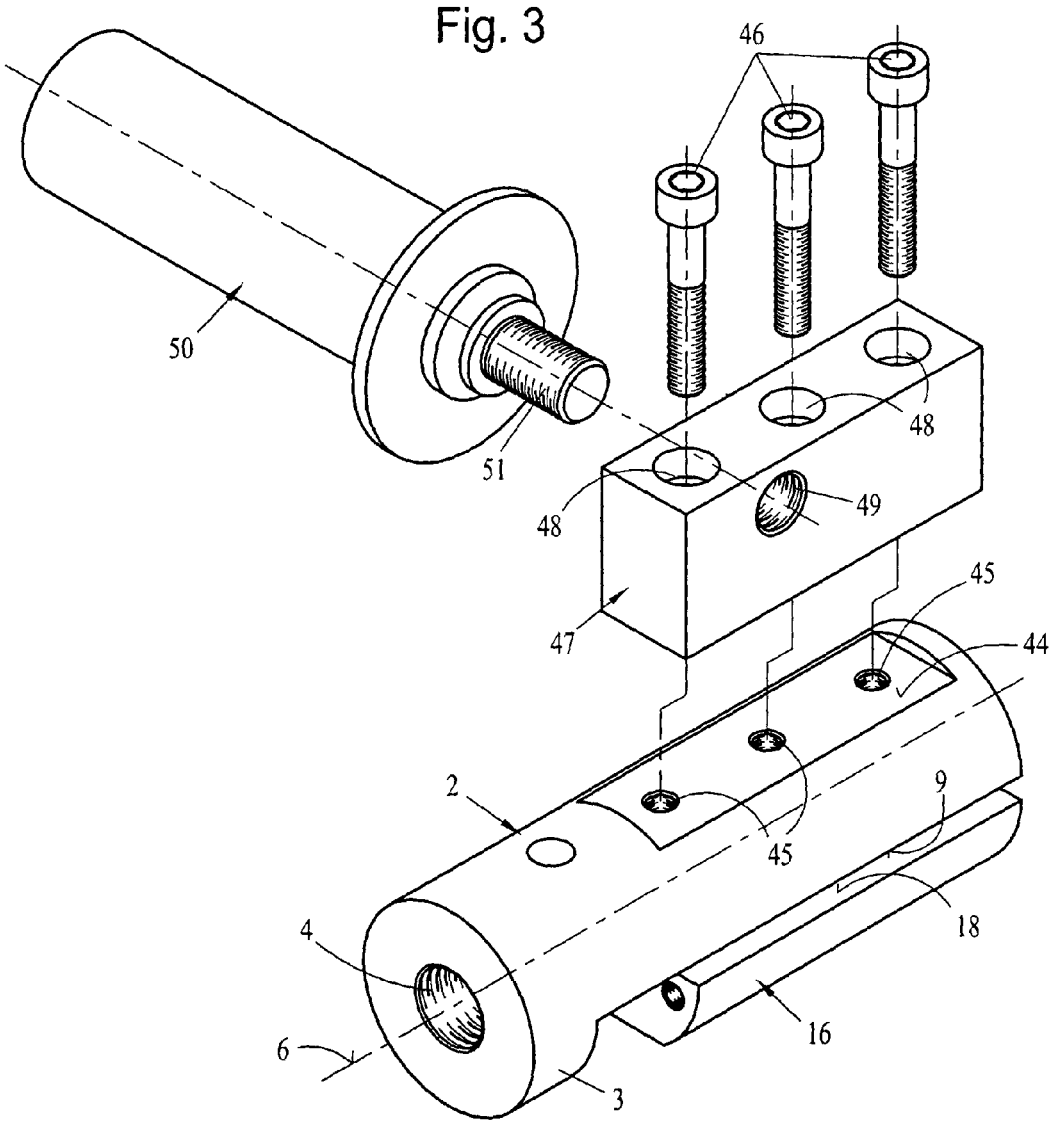
FIG. 3 is a perspective bottom view of a tool according to the present invention from FIGS. 1 and 2 together with a clamping web which may be optionally mounted as well as with a handle which may be optionally mounted.

FIG. 3 shows a perspective bottom view of the basic body 2 with the preinstalled clamping jaw 16. It can be recognized that the basic body 2 has a milled-out recess 44 on its underside, which forms a flat surface that extends in parallel to the parting plane 9 of the basic body 2.

Three mounting threads 45, with which three mounting screws 46 are associated, which are used themselves for the replaceable fastening of a clamping web 47, are provided in the area of the milled-out recess 44 in this exemplary embodiment. For mounting on the basic body 2, this clamping web 47 has through holes 48 arranged correspondingly on the milled-out recess 44 of the basic body. The clamping web 47 is used for the stationary use of the tool 1 according to the present invention for clamping this tool 1 by means of the clamping web 47, e.g., in a vise or a similar holding device.

Furthermore, this clamping web 47 is provided with a through thread 49, which, extending at right angles to the through holes 48, is arranged in the clamping web 47, as is shown in FIG. 3. This through thread 49 is used for the removable mounting of a handle 50, which is provided with a corresponding threaded pin 51 for this purpose. This handle 50 is intended for the optional use of the tool 1 according to the present invention directly at a vehicle.

Due to fact that this handle 50 is arranged in such a way that it extends at right angles to the clamping web 47 and consequently to the basic body 2, this handle offers optimal handling, especially during the bracing or clamping of a brake pipe between the clamping jaw 16 and the basic body 2, on the one hand, and during the actuation of the pressing spindle 36, on the other hand.

Figure 4:
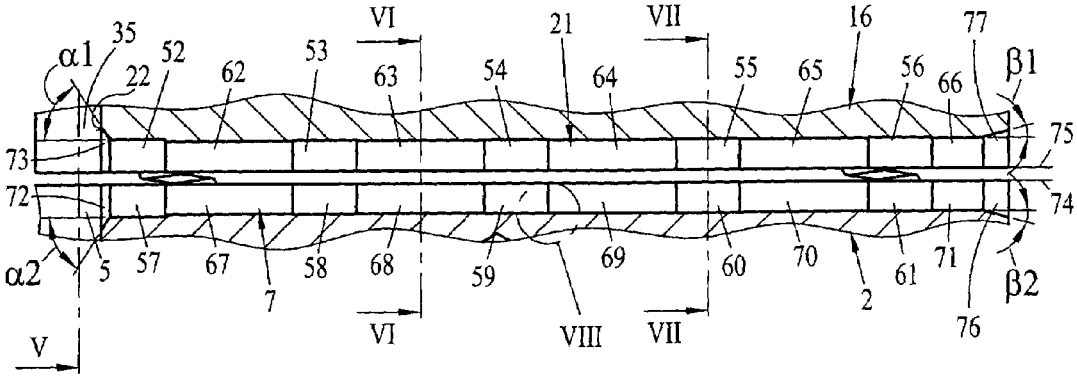
FIG. 4 is an enlarged detail of the receiving groove and of the clamping groove of the basic body, on the one hand, and of the clamping jaw from FIG. 1, on the other hand.

FIG. 4 shows an enlarged sectional view of the groove areas of the clamping groove 21 and of the clamping jaw 16, on the one hand, and of the receiving groove 7 of the basic body 2, on the other hand.

According to the exemplary embodiment according to FIG. 4, it can be recognized that both the clamping groove 21 and the receiving groove 7 are profiled in the axial direction and correspondingly have groove sections 52, 53, 54, 55 and 56 as well as 57, 58, 59, 60 and 61 designed as depressions, between which non-depressed groove sections 62, 63, 64, 65 and 66 as well as 67, 68, 69, 70 and 71 are correspondingly arranged. The axial length of the deeper groove sections 52, 53, 54, 55 and 56 as well as 57, 58, 59, 60 and 61 is about 5 mm in this exemplary embodiment, whereas the axial length of the groove sections 62, 63, 64, 65 and 66 as well as 67, 68, 69, 70 and 71 of a smaller depth is about 10 mm.

Figure 9:
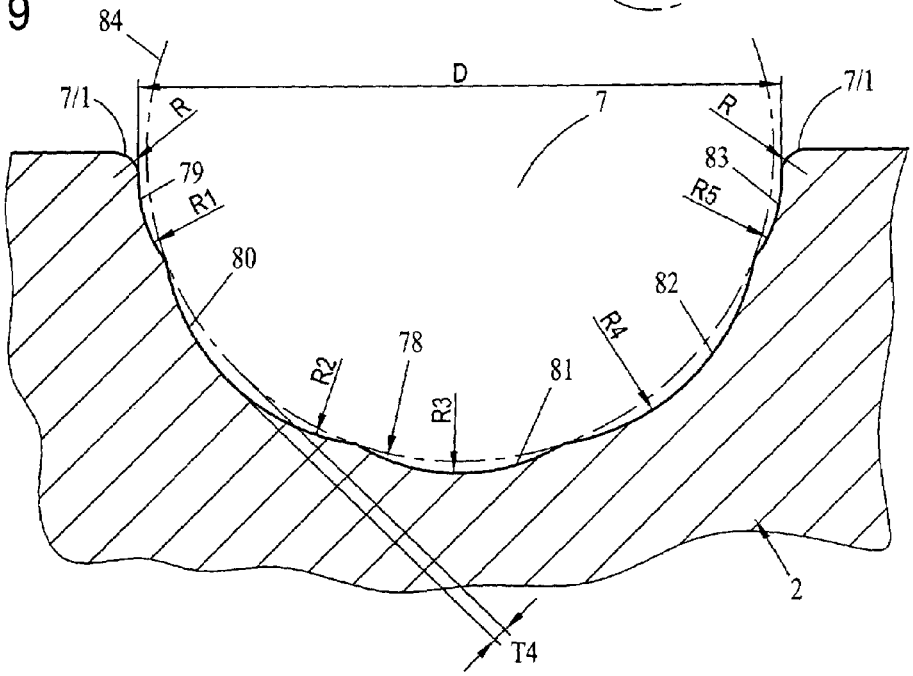
FIG. 9 is another embodiment of the receiving groove of the basic body, which is provided with cylindrical depressions, which follow each other in the circumferential direction and form a kind of wave profile.

The limiting edges 7/1 of the receiving groove 7 (FIG. 1) and the limiting edges 21/1 of the clamping groove 21 (FIG. 2) are rounded in the area of these groove sections 52 through 71 and have a radius of curvature of about 0.25 mm each, as is shown in FIG. 9 with the reference symbol R for the limiting edges 7/1 of the receiving groove 7.

Figure 5:
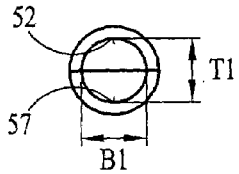
FIG. 5 is a sectional view showing an area with the dimensions of the clamping channel formed by the receiving groove and the clamping groove, corresponding to view V in FIG. 4.
Figure 6:
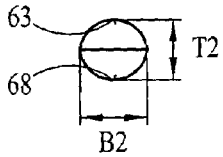
FIG. 6 is a sectional view showing an area with the dimensions of the clamping channel formed by the receiving groove and the clamping groove, along section line VI—VI in FIG. 4.
Figure 7:
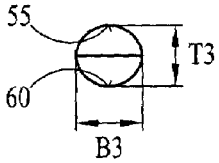
FIG. 7 is a sectional view showing an area with the dimensions of the clamping channel formed by the receiving groove and the clamping groove, along section line VII—VII in FIG. 4.

The cross-sectional shapes of the clamping channel formed from the receiving groove 7 and the clamping groove 21, which cross-sectional shapes are obtained in the pressed-together state of the clamping jaw 16 at the basic body 2, are shown in FIGS. 5, 6 and 7 in their corresponding axial areas.

Thus, FIG. 5 shows a view V of the two groove sections 52 and 57 from FIG. 4. These two groove sections 52 and 57 form a round cylinder section, so that the "overall depth" T1 recognizable from FIG. 5 is identical to the width B1 of the clamping channel formed from the receiving groove 7 and the clamping groove 21. Provisions are made here according to the present invention for the axial length of these two groove sections 52 and 57, measured from the front surface 92 of the hollow 35, to equal about 5 mm.

Furthermore, provisions are made according to the present invention for the diameter of the clamping channel in the area of the groove sections 52 and 57 to correspond to 93% to 98% of the external diameter of a coated brake pipe to be clamped. It shall be mentioned here as an example that for a coated brake pipe with a nominal external diameter of 5.25 mm, the diameter of the clamping channel in the area of these two groove sections 52 and 57 and consequently the depth T1 and the width B1 of the clamping channel in this area is, e.g., 5.1 mm.

An unintended deformation of the coated brake pipe to be flanged is reliably prevented from occurring by this measure of making the clamping channel cylindrical in the area of the two groove sections 52 and 57 and, on the other hand, an accurate shaping of the flanged head to be prepared at this brake pipe conforming to the standards is ensured as well.

A respective hollow 72 and 73, which are recognizable from FIG. 4 and which extend at identical angles ?1 and ?2 to the respective longitudinal central axis 74 and 75 of the respective corresponding receiving groove 7 and the respective clamping groove 21, are provided for this purpose in the front, outer end area of the groove sections 52 and 57. The pitch angle ?1 and ?2 is in a range of 55° to 60° and preferably equals 57.5° in this exemplary embodiment. The limiting edges of the groove sections 52 and 57 as well as of the hollows 62 and 63 have sharp edges to the respective parting plane 9 and 18.

The end areas of the receiving groove 7 and of the clamping groove 21 located opposite these hollows 72 and 73 form a kind of outlet area and are in turn provided with a respective hollow 76 and 77, which have a pitch angle of 15° to the respective central longitudinal axis 74 and 75 in this exemplary embodiment. Damage to the surface of a coated or jacketed brake pipe is reliably prevented by these outlet areas of the hollows 76 and 77 from occurring.

FIG. 6 shows the cross-sectional shape VI—VI of the clamping channel formed from the receiving groove 7 and the clamping groove 21 in the area of the two groove sections 63 and 68. This cross-sectional shape of the clamping channel is identical in the areas of the groove sections 62 and 67, 64 and 69, 65 and 70 as well as 66 and 71. It can be recognized from FIG. 6 that the overall depth T2 or the diameter T2 of the clamping channel is smaller in this area than is the width B2 of the clamping channel. Provisions are made here for the overall depth T2 for a jacketed brake pipe to be clamped, with a nominal external diameter of, e.g., 5.25 mm, to be preferably 4.78 mm. A sufficiently strong clamping force is obtained during the clamping of a brake pipe due to this smaller overall depth T2. To prevent deformation in the sense of a widening especially of the metallic core of a jacketed brake pipe, the clamping channel has a width B2 in the area of the groove sections 63 and 68 that, equaling 5.25 mm, exactly corresponds to the diameter of the jacketed brake pipe.

FIG. 7 shows the cross section of the clamping channel in the area of the groove sections 55 and 60, which is indicated by the section line VII—VII in FIG. 4. As is apparent from FIG. 7, the clamping channel likewise has an overall depth T3 in the area mentioned that is smaller than the diameter of a jacketed brake pipe to be clamped. The overall depth T3 for clamping a brake pipe with a nominal external diameter of 5.25 mm is 4.85 mm. The width B3 likewise corresponds to the diameter of the brake pipe to be clamped in this area as well and likewise equals 5.25 mm in this exemplary embodiment.

Due to the fact that the overall depth T3 is smaller than the nominal diameter of the brake pipe to be clamped, a clamping force is also generated in the area of the groove sections 55 and 60 during the clamping of the brake pipe. The other groove sections 53 and 58, 54 and 59 as well as 56 and 61 have a design identical to that of the groove sections 55 and 60, so that the corresponding cross-sectional shape according to FIG. 7 is also obtained in these areas of the clamping channel.

A clamping channel, which is provided with a plurality of depressions located one after another in the axial direction and with which an extremely snug hold of a brake pipe to be clamped is achieved, is formed due to the individual groove sections being formed in their axial succession. In addition to this stepped shape, the surface of the receiving groove 7 and of the clamping groove 21 may also be provided with additional depressions distributed in a flat pattern, which are prepared by providing a defined surface roughness with an arithmetic average peak-to-valley height Ra of, e.g., 7.5. The clamping hold of the clamped, coated brake pipe or the like is considerably improved hereby as well.

Provisions are also made for preparing the entire area of the groove sections 52 through 71 with a continuous average groove depth. The receiving groove 7 and the clamping groove 21 are provided in this case with a surface roughness with an arithmetic average peak-to-valley height Ra of, e.g., 7.5, so that secure hold of a brake pipe is reliably guaranteed in the clamped state.

Figure 8:
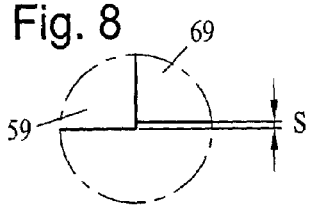
FIG. 8 is an enlarged detail of the axially stepped receiving channel VIII from FIG. 4.

FIG. 8 shows, furthermore, an enlarged detail VIII from FIG. 4 and shows such a "step" of the clamping channel or receiving groove 7 as an example. The step S between the groove section 59 and the groove section 60 equals 0.035 mm in this exemplary embodiment and is consequently extremely small for clamping a brake pipe with a diameter of 5.25 mm. However, it is achieved due to this extremely small step that the surface of a jacketed brake pipe undergoes only a minimal deformation at best during clamping, so that the jacketing of the brake pipe cannot be damaged during the clamping. At the same time, extremely good holding of a clamped brake pipe is achieved due to these multiple axial steps with the depressions of the clamping channel located one after another, and no unacceptable permanent deformations of the surface of the coating and of the metallic core of a brake pipe can occur after the release because of the shaping of these groove sections.

FIG. 9 shows another example of a cross-sectional shape according to the present invention based on the example of the receiving groove 7 of the basic body 2. As is apparent from FIG. 9, the inner wall 78 of the receiving groove 7 has a kind of circular wave structure. This may be prepared, e.g., by arranging the groove sections 79, 80, 81, 82 and 83 in such a way that they follow each other in the circumferential direction, as is apparent from, e.g., FIG. 9. These groove sections 79 through 83 form cylinder sections whose radii of curvature R1, R2, R3, R4, R5 are smaller than the overall diameter D of the receiving groove 7.

This results in a plurality of depressions following each other in the circumferential direction, which have a maximum depth T4 of 0.1 mm in relation to the common inner circle 84 in this exemplary embodiment. Provisions are preferably made here for the depth T4 to be about 0.05 mm. Improved hold of a clamped brake pipe is also achieved by this surface structure of the receiving groove 7, and the surface of the brake pipe is not deformed in an unacceptable manner during clamping because of the minimal value of the depth T4.

Provisions are also made in connection with this cross-sectional shape according to FIG. 9 that the front end area of the clamping channel located toward the pressing spindle 36 (FIG. 1) is likewise made cylindrical with its hollows 72 and 73 corresponding to the groove sections 52 and 57 from FIG. 4. This cylindrical design of the end areas of the clamping channel in the area of the groove sections 52 and 57 according to FIG. 4, together with the hollows 72 and 73, make possible the optimal shaping of a flanged head to be prepared on a brake pipe conforming to the standards. The surfaces of the cylindrical sections 79 through 83 may also be provided with a surface roughness with an arithmetic average peak-to-valley height Ra of, e.g., 7.5 in order to additionally improve the hold of a clamped brake pipe.

Figure 10:
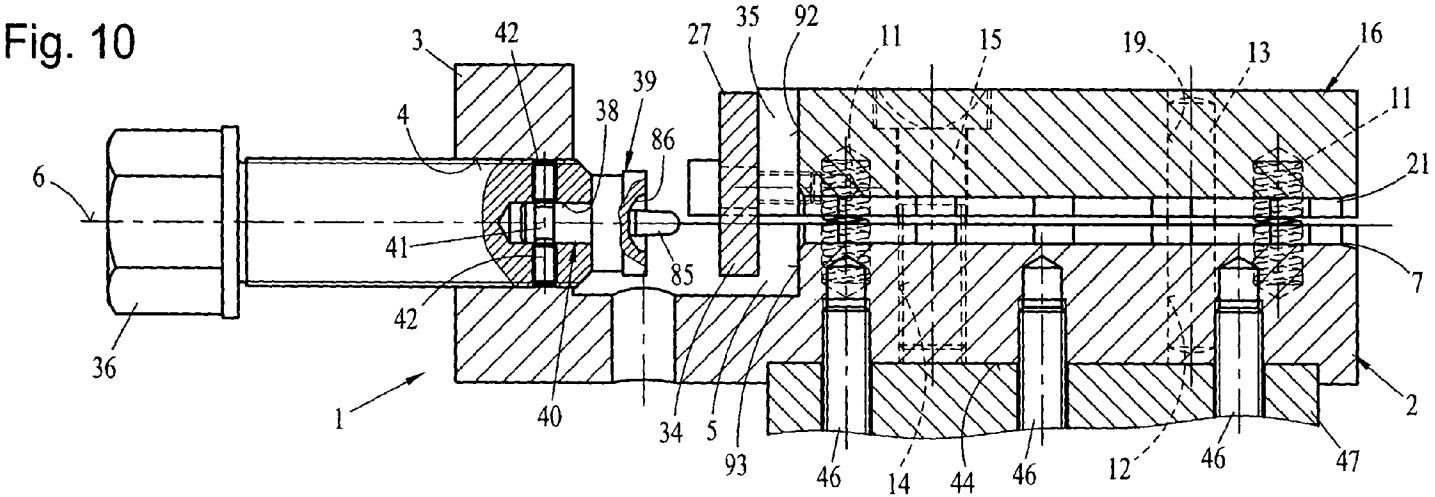
FIG. 10 is a vertical sectional view through a completely mounted tool.

FIG. 10 shows a vertical section through the completely mounted tool 1. It can be recognized that the pressing spindle 36 is screwed into the internal thread 4 of the head part 3 of the basic body 2. The flanging pressure piece 39 is inserted with its mounting pin 40 into the mounting hole 38 of the pressing spindle 36 and secured in this position by means of the stud screws 42.

It can also be recognized that the flanging pressure piece 39 has an axially projecting forming pin 85, which protrudes into the brake pipe to be flanged during the flanging operation. In the area surrounding this forming pin 85 the flanging pressure piece 39 is provided, as is sufficiently known from the state of the art, with a recessed forming surface, by which the flanged head proper is formed at the end of the brake pipe by "jumping" this end.

Furthermore, FIG. 10 shows that the coil springs 11 correspondingly protrude in this preassembled state into the corresponding blind holes 10 of the respective basic bodies 2 and 20 of the clamping jaw 16 and hold the clamping jaw 16 at a spaced location from the basic body 2. Furthermore, it is seen that the alignment pin 13 is pressed into the mounting hole 12 of the basic body 2 and engages the through hole 19 of the clamping jaw 16. Furthermore, one of the tightening screws 15, which passes through the through hole 17 of the clamping jaw 16 and is screwed into the internal thread 14 of the basic body 2, is shown by broken lines. The distance between the clamping jaw 16 and the basic body 2, which is maintained by the coil springs 11, is set by means of the tightening screws 15 such that a brake pipe to be flanged can be pushed axially into the receiving groove 7 of the basic body 2 and into the clamping groove 21 of the clamping jaw 16.

It can also be recognized from FIG. 10 that the swing wall 27 is in its active position and the depth to which the brake pipe can be pushed in is limited by the stop 34 of the swing wall 27, which said stop 34 is the lower stop in FIG. 10. A jacketed brake pipe 87 to be flanged, as is shown in FIG. 11 as an example, can thus be introduced into the tool 1 according to the present invention in a defined manner.

The brake pipe with its central longitudinal axis 88 is above the central longitudinal axis 74 of the receiving groove 7 in this nonbraced state corresponding to the smaller depth of the receiving groove 7. The brake pipe 87 is pressed between the clamping groove 21 and the receiving groove 7 during the subsequent clamping operation, which is brought about by correspondingly tightening the tightening screws 15, so that the brake pipe is aligned with its central longitudinal axis 88 coaxially with the central longitudinal axis 74 of the receiving groove 7 and at the same time with the central longitudinal axis 75 of the clamping jaw 16, which is congruent with the central longitudinal axis 74 in the completely braced state.

Because of the above-described, special shaping of the receiving channel or the clamping groove 21 and the receiving groove 7, the clamped brake pipe 87 is thus aligned completely coaxially with the central longitudinal axes 74 and 75, on the one hand, and with the central axis 6 of the internal thread 4 of the basic body in the head part 3 of the latter, on the other hand.

Figure 11:
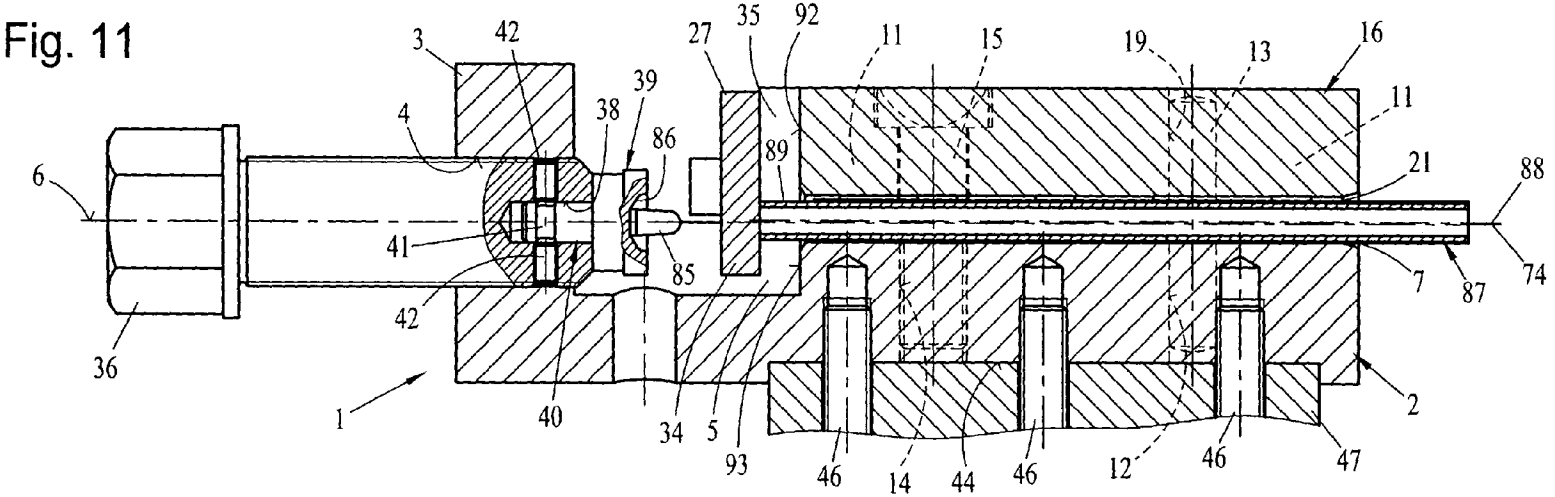
FIG. 11 is a sectional view of the tool from FIG. 10 with the coated brake pipe inserted.
Figure 12:
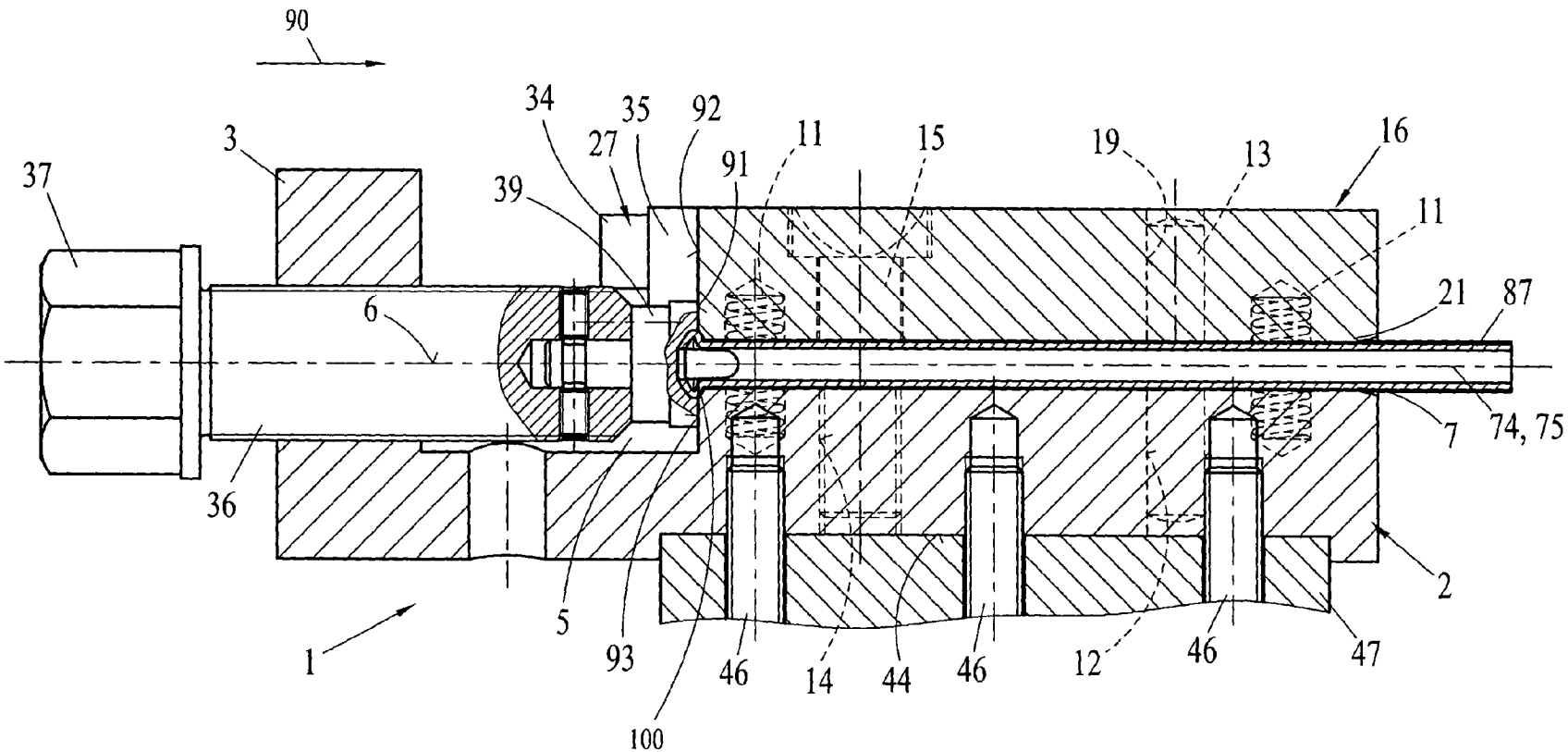
FIG. 12 is a sectional view of the tool from FIG. 11 with an inserted brake pipe, where a completely mounted flanged head is already formed at one end of the tool.

Once the brake pipe 87 has now been clamped in its desired position, the swing wall 27 is now pivoted from its active position according to FIG. 11 into a neutral position, as is shown in FIG. 12, so that the front end 89 of the brake pipe 87 is freely accessible. The pressing spindle 36 is subsequently actuated via its drive hexagon 37, so that the flanging pressure piece 39 reaches the position shown in FIG. 12.

The pressing spindle 36 is now adjusted in the direction of the arrow 90 until the flanging pressure piece 39 is flatly in contact with its front surface 91 with the inner front surface 92 of the hollow 35 of the clamping jaw 16 and the inner front surface 93 of the recess 5 of the basic body 2. These two front surfaces 92 and 93 are now located in a common plane, which extends at right angles to the central longitudinal axis 6 of the internal thread 4 and to the respective central longitudinal axes 74 and 75 of the receiving groove 7 and of the clamping groove 21, respectively. The flanged head 100 is formed completely on the brake pipe 87 in this axial end position of the flanging pressure piece 39, as it can be recognized from FIG. 12, and it has a shape conforming to the standards.

Furthermore, FIGS. 10, 11 and 12 show details from which it can be recognized that the clamping web 47 is mounted snugly in the milled-out recess 44 on the underside of the basic body 2 by means of the mounting screws 46.

It shall also be mentioned here that the jacket must have been removed from the brake pipe in advance over an axial length of about 7 mm in its end area in which the flanged head 100 shall be formed.

Nonjacketed brake pipes or metal pipes of a conventional type with a corresponding external diameter can also be flanged with the device according to the present invention and can be provided with a flanged head.

While specific embodiments of the invention have been shown and described in detail to illustrate the application of the principles of the invention, it will be understood that the invention may be embodied otherwise without departing from such principles.

What is claimed is:

1. A tool for flanging coated brake pipes of a motor vehicle, the tool comprising:

a basic body with an approximately semicylindrical receiving groove;

a clamping jaw with an approximately semicylindrical clamping groove, said receiving groove and said clamping groove together forming a clamping channel for clampingly holding the brake pipe, said basic body and said clamping jaw together defining a parting plane;

a pressing spindle arranged at said basic body and extending coaxially with the clamping channel and adjustable in relation to the clamping channel;

a flanging pressure piece provided at a channel-side end of said pressing spindle forming the flanged head of the brake pipe, wherein the diameter of the clamping channel at right angles to the parting plane is smaller over at least approximately its entire length than the pipe diameter of the brake pipe, and surfaces of the receiving groove and of the clamping groove which form the clamping channel have an arithmetic average peak-to-valley height Ra of 5.0 to 10.0.

2. A tool in accordance with claim 1, wherein a surface roughness and radial and axial depressions are provided in different combinations.

3. A tool in accordance with claim 1, wherein in an area of a parting plane between said basic body and said clamping jaw said receiving groove and said clamping groove has a width that corresponds to an external diameter of the brake pipe.

4. A tool in accordance with claim 1, wherein limiting edges of said receiving groove and said clamping groove to a corresponding parting plane between said basic body and said clamping jaw are rounded and have a radius of curvature of 0.1 mm to 0.4 mm.

5. A tool in accordance with claim 1, wherein in an area of said clamping channel end directed toward said pressing spindle, said clamping channel has a round cross section having a diameter corresponding approximately to 93% to 98% of the external diameter of the brake pipe over an axial length of 4 mm to 6 mm.

6. A tool in accordance with claim 4, wherein limiting edges of said receiving groove and of said clamping groove have sharp edges to the respective parting plane belonging to said receiving groove and of said clamping groove in an area of said cylindrical sections.

7. A tool in accordance with claim 1, wherein said clamping channel has a hollow toward said pressing spindle with a depth of up to 1 mm, whose conical surface extends at a angle of 55° to 60° to the central longitudinal axis of the clamping channel, and limiting edges of the respective hollows have sharp edges toward the respective parting planes.

8. A tool in accordance with claim 1, wherein at an end of said clamping channel located opposite the pressing spindle said clamping channel has an outlet section with a length of up to 3 mm in the form a hollow extending at an outlet angle of 10° to 20° to the central longitudinal axis of the clamping channel.

9. A tool in accordance with claim 1, wherein a front side directed toward the pressing spindle of said clamping jaw has a swing wall pivotable from a neutral position into an intermediate space between said clamping groove and said pressing spindle for positioning the coated brake pipe in said clamping groove and forms a stop for the brake pipe in this pivoted-in position.

10. A tool in accordance with claim 1, wherein said receiving groove and said clamping groove have the same bottom depth.

11. A tool in accordance with claim 1, wherein a clamping channel is formed from said receiving groove and said clamping groove and has a clamping length of 6.5 cm to 10 cm for receiving the coated brake pipe.

12. A tool in accordance with claim 1, further comprising a clamping web is removably fastened to the basic body.

13. A tool in accordance with claim 12, further comprising a handle extending at right angles to said clamping channel and at right angles to said clamping web and removably fastened to said clamping web.

14. A tool for flanging coated brake pipes of a motor vehicle, the tool comprising:

a basic body with an approximately semicylindrical receiving groove;

a clamping jaw with an approximately semicylindrical clamping groove, said receiving groove and said clamping groove together forming a clamping channel for clampingly holding the brake pipe, said basic body and said clamping jaw together defining a parting plane;

a pressing spindle arranged at said basic body and extending coaxially with the clamping channel and adjustable in relation to the clamping channel;

a flanging pressure piece provided at a channel-side end of said pressing spindle forming the flanged head of the brake pipe, wherein the diameter of the clamping channel at right angles to the parting plane is smaller over at least approximately its entire length than the pipe diameter of the brake pipe and the surfaces of the receiving groove and of the clamping groove forming the clamping channel are provided with depressions located one after another in a circumferential direction and formed by cylinder sections of said receiving groove and of said clamping groove, said cylinder sections following each other in a circumferential direction and alternatingly have equal or different radii of curvature and said radial depressions have a maximum depth of 0.1 mm.

15. A tool in accordance with claim 14, wherein radial depressions are located one after another in the circumferential direction and are formed by said cylinder sections to provide a wave profile.

16. A tool in accordance with claim 14, wherein a sum of the groove depths of said receiving groove and of said clamping groove is up to 1.9% smaller than the external diameter of the brake pipe.

17. A tool for flanging coated brake pipes of a motor vehicle, the tool comprising:

a basic body with an approximately semicylindrical receiving groove;

a clamping jaw with an approximately semicylindrical clamping groove, said receiving groove and said clamping groove together forming a clamping channel for clampingly holding the brake pipe, said basic body and said clamping together defining a parting plane;

a pressing spindle arranged at said basic body and extending coaxially with the clamping channel and adjustable in relation to the clamping channel;

a flanging pressure piece provided at a channel-side end of said pressing spindle forming the flanged head of the brake pipe, wherein the diameter of the clamping channel at right angles to the parting plane is smaller over at least approximately its entire length than the pipe diameter of the brake pipe and the surfaces of said receiving groove and of said clamping groove forming the clamping channel are provided with groove sections with one of semi-cylindrical and semi-elliptical smooth surfaces of greater and lesser groove depth alternating in an axial direction, and each of said groove sections have a width that is consent and corresponds to the external diameter of the coated brake pipe to be flanged.

18. A tool in accordance with claim 17, wherein said groove sections of greater and lesser groove depth alternating in an axial direction are provided with said groove sections of a lesser depth of the receiving groove associated in pairs with said groove sections of lesser depth of the clamping groove.

19. A tool in accordance with claim 18, wherein the difference of the sum of the groove depths of said receiving groove and of said clamping groove is in a range of 0.025 mm to 0.1 mm.

20. A tool in accordance with claim 17, wherein said groove sections have an axial length of about 4 mm to 11 mm.

21. A tool in accordance with claim 18, wherein the difference of the sum of the groove depths of said receiving groove and of said clamping groove is 0.07 mm.

* * * * *